US009850902B2

(12) United States Patent
Nemit, Jr. et al.

(10) Patent No.: US 9,850,902 B2
(45) Date of Patent: Dec. 26, 2017

(54) COMPRESSOR WITH A BYPASS PORT

(75) Inventors: Paul Nemit, Jr., Waynesboro, PA (US); Angela Marie Comstock, Roanoke, VA (US); William L. Kopko, Jacobus, PA (US)

(73) Assignee: Johnson Controls Technology Company, Milwaukee, WI (US)

( * ) Notice: Subject to any disclaimer, the term of this patent is extended or adjusted under 35 U.S.C. 154(b) by 845 days.

(21) Appl. No.: 13/258,494

(22) PCT Filed: Mar. 26, 2010

(86) PCT No.: PCT/US2010/028966

§ 371 (c)(1),
(2), (4) Date: Sep. 22, 2011

(87) PCT Pub. No.: WO2010/111685

PCT Pub. Date: Sep. 30, 2010

(65) Prior Publication Data

US 2012/0027632 A1 Feb. 2, 2012

Related U.S. Application Data

(60) Provisional application No. 61/163,647, filed on Mar. 26, 2009.

(51) Int. Cl.
*F04C 18/16* (2006.01)
*F04C 28/12* (2006.01)
(Continued)

(52) U.S. Cl.
CPC ..... *F04C 28/26* (2013.01); *F04C 18/16* (2013.01); *F04C 28/06* (2013.01); *F04C 28/12* (2013.01);
(Continued)

(58) Field of Classification Search
CPC ..... F04C 18/14; F04C 18/16; F04C 28/10; F04C 28/12; F04C 28/16; F04C 28/18; F04C 28/26; F04C 28/125
(Continued)

(56) References Cited

U.S. PATENT DOCUMENTS 2,519,913 A * 8/1950 Lysholm ..... 418/201.2
3,088,659 A 5/1963 Nilsson et al.
(Continued)

FOREIGN PATENT DOCUMENTS

EP 0350426 A2 1/1990
EP 1128067 A1 8/2001
(Continued)

OTHER PUBLICATIONS

Extended European Search Report for EP Application No. 16204340.0 dated Mar. 23, 2017, 17 pgs.
(Continued)

*Primary Examiner* — Peter J Bertheaud
(74) *Attorney, Agent, or Firm* — Fletcher Yoder, P.C.

(57) ABSTRACT

A system is provided for adjusting the volume ratio of a screw compressor. The system can use a port in a rotor cylinder to bypass vapor from the compression chamber to the discharge passage of the compressor. A valve can be used to open or close the port to obtain different volume ratios in the compressor.

11 Claims, 15 Drawing Sheets

(51) Int. Cl.

| | |
|---|---|
| ***F04C 28/16*** | (2006.01) |
| ***F04C 28/18*** | (2006.01) |
| ***F04C 28/26*** | (2006.01) |
| ***F04C 28/06*** | (2006.01) |

(52) U.S. Cl.
CPC ..... *F04C 28/125* (2013.01); *F04C 28/16* (2013.01); *F04C 28/18* (2013.01)

(58) Field of Classification Search
USPC ..... 417/307, 308, 310, 410.3, 410.4, 410.5, 417/440; 418/201.2
See application file for complete search history.

(56) References Cited

U.S. PATENT DOCUMENTS

| | | | | |
|---|---|---|---|---|
| 3,432,089 | A | 3/1969 | Schibbye | |
| 3,549,280 | A | 12/1970 | Linneken | |
| 4,222,712 | A | 9/1980 | Huber et al. | |
| 4,362,472 | A | 12/1982 | Axelsson | |
| 4,383,805 | A * | 5/1983 | Teegarden et al. | 417/308 |
| 4,388,048 | A | 6/1983 | Shaw et al. | |
| 4,412,788 | A | 11/1983 | Shaw et al. | |
| 4,455,131 | A | 6/1984 | Werner-Larsen | |
| 4,508,491 | A | 4/1985 | Schaefer | |
| 4,515,540 | A | 5/1985 | Pillis | |
| 4,516,914 | A | 5/1985 | Murphy et al. | |
| 4,544,333 | A | 10/1985 | Hirano | |
| 4,609,329 | A | 9/1986 | Pillis et al. | |
| 4,611,976 | A | 9/1986 | Schibbye et al. | |
| 4,946,362 | A * | 8/1990 | Soderlund et al. | 418/201.2 |
| 5,108,269 | A * | 4/1992 | Glanvall | 417/310 |
| 6,135,744 | A | 10/2000 | Andersen et al. | |
| 6,422,846 | B1 | 7/2002 | Zhong et al. | |
| 6,494,699 | B2 * | 12/2002 | Sjoholm et al. | 418/201.2 |
| 6,530,753 | B2 * | 3/2003 | Aramaki | 417/310 |
| 8,082,747 | B2 * | 12/2011 | Sjoholm et al. | 62/228.5 |
| 8,308,448 | B2 * | 11/2012 | Fields et al. | 417/310 |
| 8,328,531 | B2 * | 12/2012 | Milliff et al. | 417/310 |
| 8,622,725 | B2 * | 1/2014 | Tsuboi | 418/201.2 |
| 8,801,395 | B2 * | 8/2014 | Heimonen | F04C 18/16 417/307 |
| 8,899,942 | B2 * | 12/2014 | Kopko | F04C 18/16 417/213 |
| 2001/0046443 | A1 | 11/2001 | Van De Putte | |
| 2004/0109782 | A1 | 6/2004 | Tang et al. | |
| 2004/0247465 | A1 * | 12/2004 | Yoshimura | 417/410.4 |
| 2009/0308471 | A1 * | 12/2009 | Heimonen | 137/624.27 |

FOREIGN PATENT DOCUMENTS

| | | | |
|---|---|---|---|
| GB | 384355 | A | 12/1932 |
| GB | 2083868 | A | 3/1982 |
| JP | S57129994 | U | 8/1982 |

OTHER PUBLICATIONS

European Office Action for EP Application No. 10713066.8 dated Mar. 9, 2017, 5 pgs.

* cited by examiner

FIG−10

COMPRESSOR WITH A BYPASS PORT

CROSS-REFERENCE TO RELATED APPLICATIONS

This application claims priority from and the benefit of U.S. Provisional Application No. 61/163,647, entitled COMPRESSOR, filed Mar. 26, 2009 which is hereby incorporated by reference.

BACKGROUND

The application generally relates to positive-displacement compressors. The application relates more specifically to controlling the volume ratio of a screw compressor.

In a rotary screw compressor, intake and compression can be accomplished by two tightly-meshing, rotating, helically lobed rotors that alternately draw gas into the threads and compress the gas to a higher pressure. The screw compressor is a positive displacement device with intake and compression cycles similar to a piston/reciprocating compressor. The rotors of the screw compressor can be housed within tightly fitting bores that have built in geometric features that define the inlet and discharge volumes of the compressor to provide for a built in volume ratio of the compressor. The volume ratio of the compressor should be matched to the volume ratio of the system in which the compressor is incorporated, thereby avoiding over or under compression, and the resulting lost work. In a closed loop refrigeration system, the volume ratio of the system is established in the hot and cold side heat exchangers.

Fixed volume ratio compressors can be used to avoid the cost and complication of variable volume ratio machines. A screw compressor having fixed inlet and discharge ports built into the housings can be optimized for a specific set of suction and discharge conditions/pressures. However, the system in which the compressor is connected rarely operates at exactly the same conditions hour to hour, especially in an air conditioning application. Nighttime, daytime, and seasonal temperatures can affect the volume ratio of the system and the efficiency with which the compressor operates. In a system where the load varies, the amount of heat being rejected in the condenser fluctuates causing the high side pressure to rise or fall, resulting in a volume ratio for the compressor that deviates from the compressor's optimum volume ratio.

For example, a refrigeration system can include a compressor, condenser, expansion device, and evaporator. The efficiency of the compressor is related to the saturated conditions within the evaporator and condenser. The pressure in the condenser and evaporator can be used to establish the pressure ratio of the system external to the compressor. In the current example, the pressure ratio/compression ratio can be 4. The volume ratio or Vi is linked to the compression ratio by the relation Vi raised to the power of 1/k; k being the ratio of specific heat of the gas or refrigerant being compressed. Using the previous relation, the volume ratio to be built into the compressor geometry for the current example is 3.23 for optimum performance at full load conditions. However, during part load, low ambient conditions, or nighttime, the saturated condition of the condenser in the refrigeration system decreases while evaporator conditions remain relatively constant. To maintain optimum performance of the compressor at part load or low ambient conditions, the Vi for the compressor should be lowered to 2.5.

Therefore, what is needed is a system to vary the volume ratio of the compressor at part load or low ambient conditions without using costly and complicated devices such as slide valves.

SUMMARY

The present invention is directed to a compressor including a compression mechanism. The compression mechanism is configured and positioned to receive vapor from an intake passage and provide compressed vapor to a discharge passage. The compressor also includes a port positioned in the compression mechanism to bypass a portion of the vapor in the compression mechanism to the discharge passage and a valve configured and positioned to control vapor flow through the port. The valve has a first position to permit vapor flow from the compression mechanism to the discharge passage and a second position to prevent vapor flow from the compression mechanism to the discharge passage. The compressor has a first volume ratio in response to the valve being in the second position and a second volume ratio in response to the valve being in the first position. The first volume ratio is greater than the second volume ratio. The valve is controllable in response to predetermined conditions to operate the compressor at the first volume ratio or the second volume ratio.

The present invention is also directed to a screw compressor including an intake passage to receive vapor, a discharge passage to supply vapor and a pair of intermeshing rotors. Each rotor of the pair of intermeshing rotors is positioned in a corresponding cylinder. The pair of intermeshing rotors is configured to receive vapor from the intake passage and provide compressed vapor to the discharge passage. The screw compressor also includes a port positioned in at least one rotor cylinder to bypass a portion of the vapor in a compression pocket formed by the pair of intermeshing rotors to the discharge passage and a valve configured and positioned to control vapor flow through the port. The valve has an open position to permit vapor flow from the compression pocket to the discharge passage and a closed position to prevent vapor flow from the compression pocket to the discharge passage. The compressor has a first volume ratio in response to the valve being in the closed position and a second volume ratio in response to the valve being in the open position. The first volume ratio is greater than the second volume ratio. The valve is controllable in response to predetermined conditions to operate the compressor at the first volume ratio or the second volume ratio.

One advantage of the present application is an improved energy efficiency rating (EER) over a fixed volume ratio compressor due to better part-load performance resulting from the use of a lower volume ratio.

DETAILED DESCRIPTION OF THE EXEMPLARY EMBODIMENTS

Figure 1:
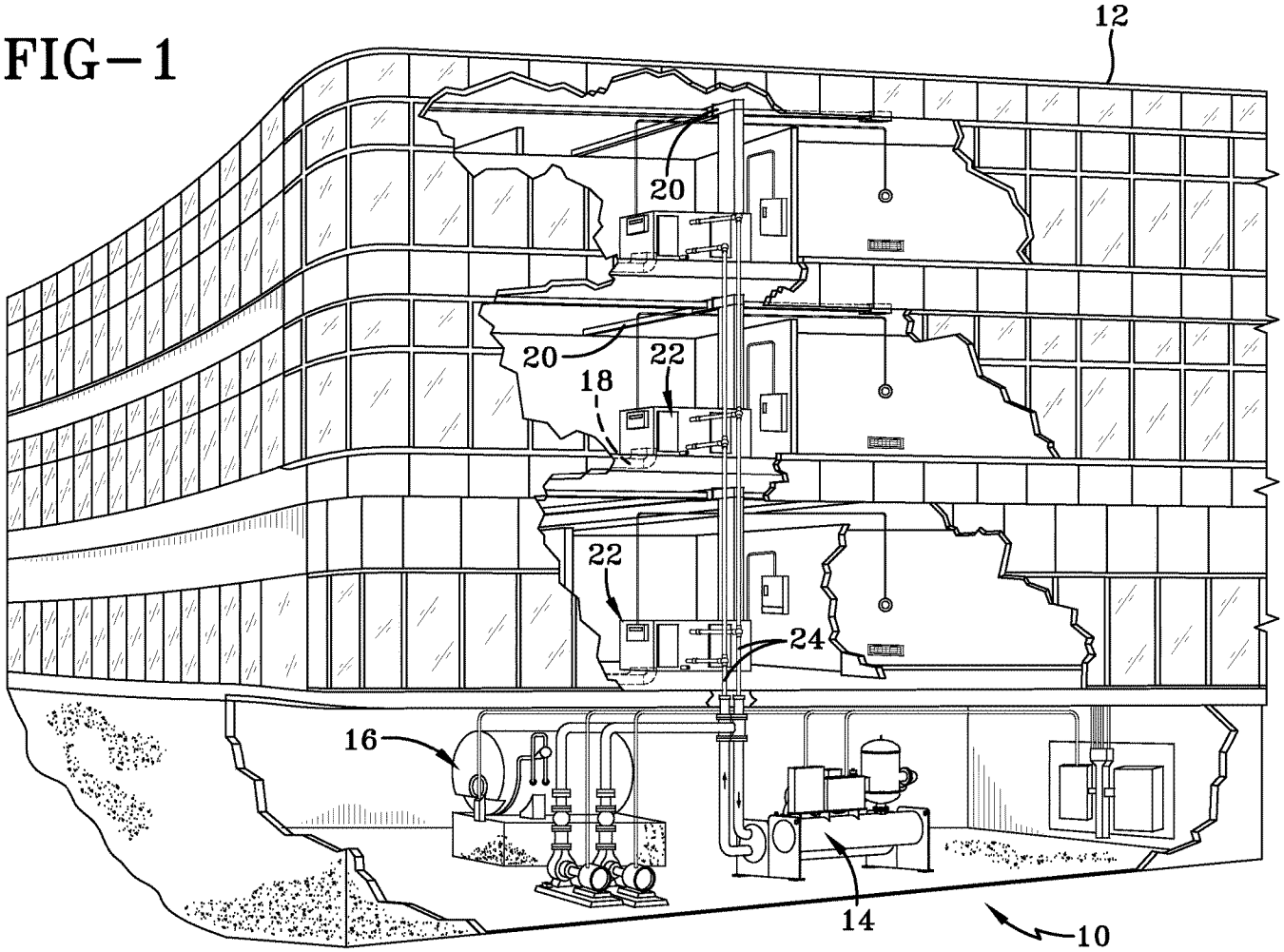
FIG. 1 shows an exemplary embodiment for a heating, ventilation and air conditioning system.

FIG. 1 shows an exemplary environment for a heating, ventilation and air conditioning (HVAC) system 10 in a building 12 for a typical commercial setting. System 10 can include a vapor compression system 14 that can supply a chilled liquid which may be used to cool building 12. System 10 can include a boiler 16 to supply heated liquid that may be used to heat building 12, and an air distribution system which circulates air through building 12. The air distribution system can also include an air return duct 18, an air supply duct 20 and an air handler 22. Air handler 22 can include a heat exchanger that is connected to boiler 16 and vapor compression system 14 by conduits 24. The heat exchanger in air handler 22 may receive either heated liquid from boiler 16 or chilled liquid from vapor compression system 14, depending on the mode of operation of system 10. System 10 is shown with a separate air handler on each floor of building 12, but it is appreciated that the components may be shared between or among floors.

Figure 2:
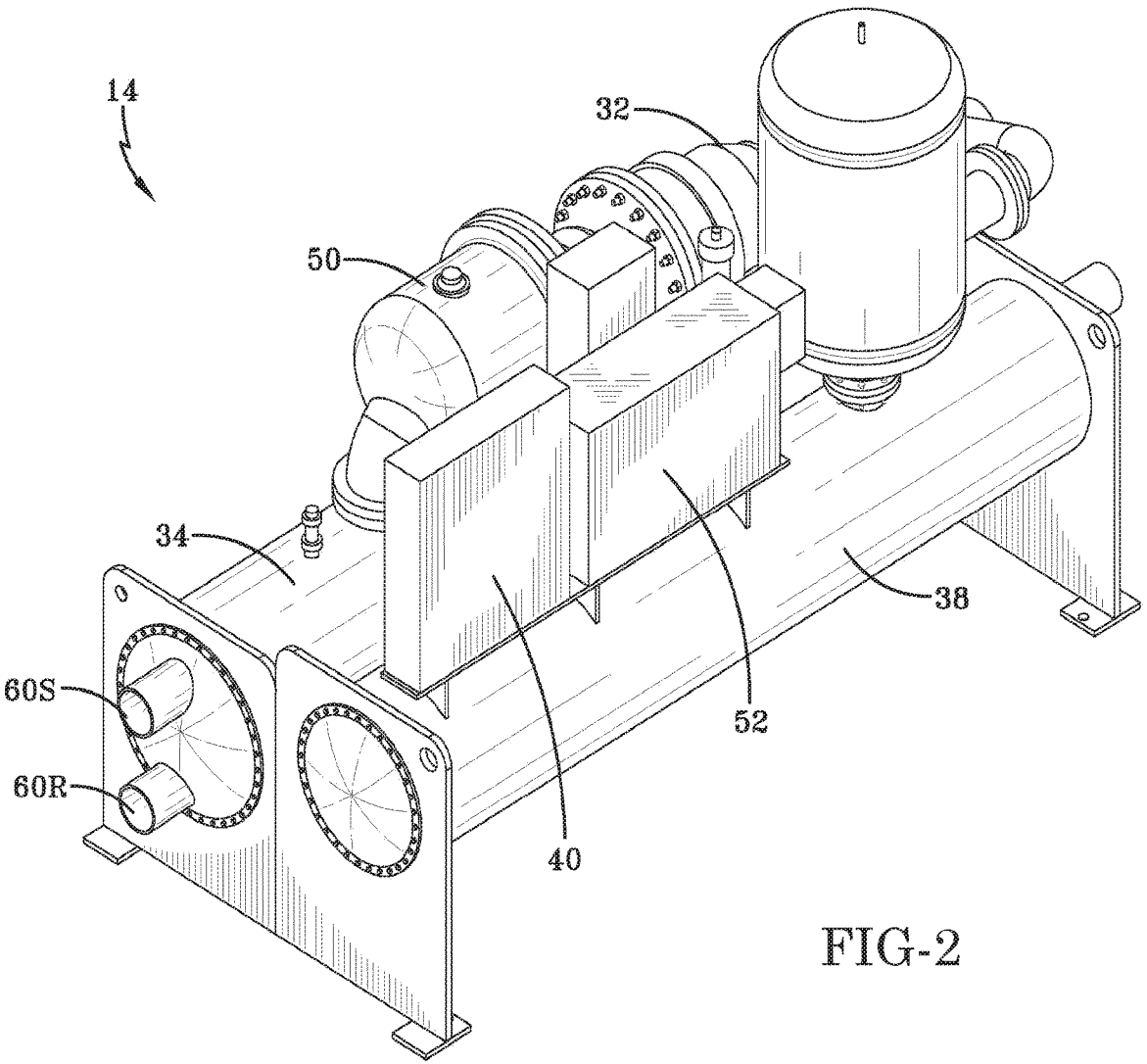
FIG. 2 shows an isometric view of an exemplary vapor compression system.
Figure 3:
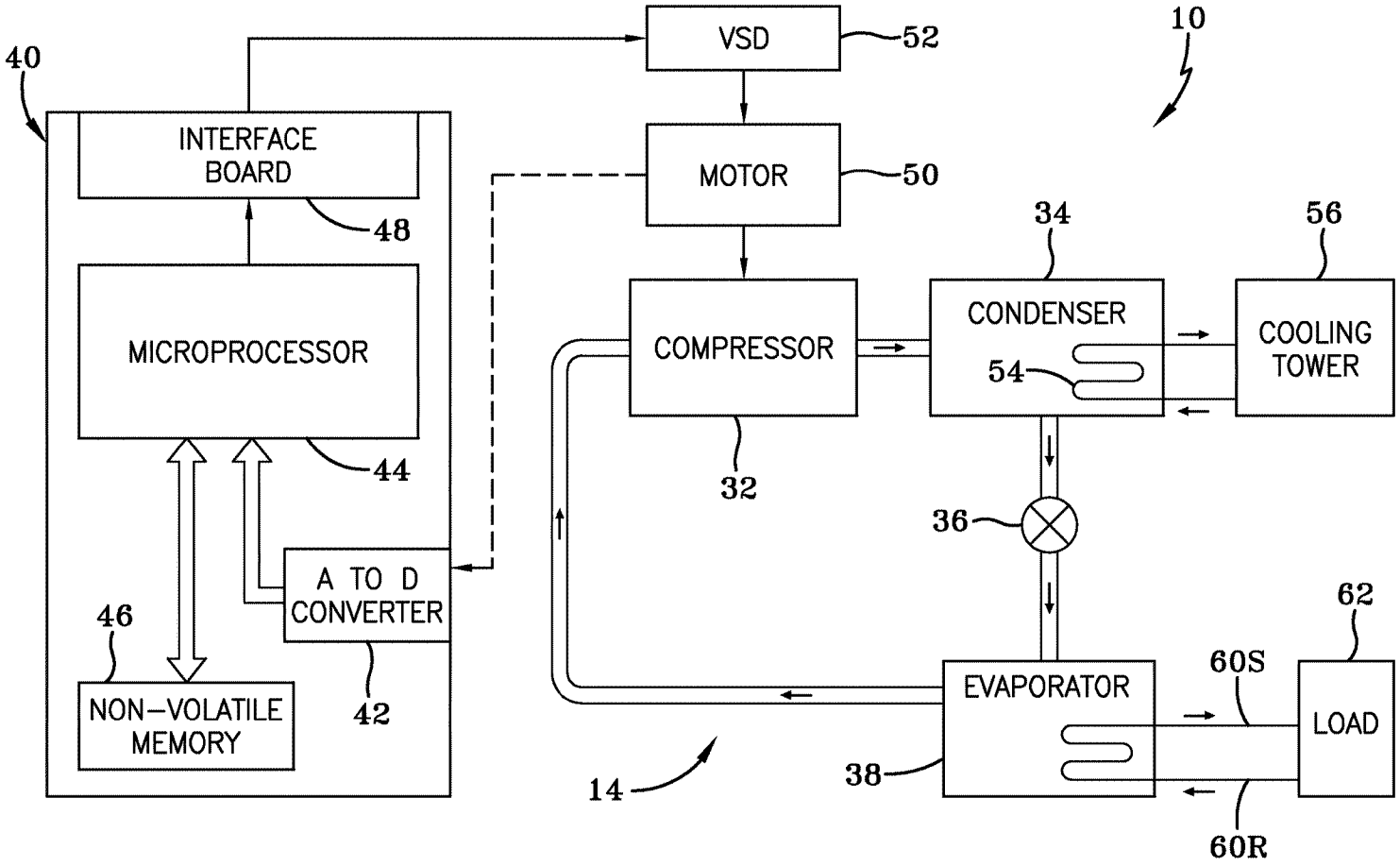
FIGS. 3 and 4 schematically show exemplary embodiments of a vapor compression system.

FIGS. 2 and 3 show an exemplary vapor compression system 14 that can be used in HVAC system 10. Vapor compression system 14 can circulate a refrigerant through a circuit starting with compressor 32 and including a condenser 34, expansion valve(s) or device(s) 36, and an evaporator or liquid chiller 38. Vapor compression system 14 can also include a control panel 40 that can include an analog to digital (A/D) converter 42, a microprocessor 44, a non-volatile memory 46, and an interface board 48. Some examples of fluids that may be used as refrigerants in vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In an exemplary embodiment, vapor compression system 14 may use one or more of each of variable speed drives (VSDs) 52, motors 50, compressors 32, condensers 34, expansion valves 36 and/or evaporators 38.

Motor 50 used with compressor 32 can be powered by a variable speed drive (VSD) 52 or can be powered directly from an alternating current (AC) or direct current (DC) power source. VSD 52, if used, receives AC power having a particular fixed line voltage and fixed line frequency from the AC power source and provides power having a variable voltage and frequency to motor 50. Motor 50 can include any type of electric motor that can be powered by a VSD or directly from an AC or DC power source. Motor 50 can be any other suitable motor type, for example, a switched reluctance motor, an induction motor, or an electronically commutated permanent magnet motor. In an alternate exemplary embodiment, other drive mechanisms such as steam or gas turbines or engines and associated components can be used to drive compressor 32.

Compressor 32 compresses a refrigerant vapor and delivers the vapor to condenser 34 through a discharge passage. Compressor 32 can be a screw compressor in one exemplary embodiment. The refrigerant vapor delivered by compressor 32 to condenser 34 transfers heat to a fluid, for example, water or air. The refrigerant vapor condenses to a refrigerant liquid in condenser 34 as a result of the heat transfer with the fluid. The liquid refrigerant from condenser 34 flows through expansion device 36 to evaporator 38. In the exemplary embodiment shown in FIG. 3, condenser 34 is water cooled and includes a tube bundle 54 connected to a cooling tower 56.

The liquid refrigerant delivered to evaporator 38 absorbs heat from another fluid, which may or may not be the same type of fluid used for condenser 34, and undergoes a phase change to a refrigerant vapor. In the exemplary embodiment shown in FIG. 3, evaporator 38 includes a tube bundle having a supply line 60S and a return line 60R connected to a cooling load 62. A process fluid, for example, water, ethylene glycol, calcium chloride brine, sodium chloride brine, or any other suitable liquid, enters evaporator 38 via return line 60R and exits evaporator 38 via supply line 60S. Evaporator 38 chills the temperature of the process fluid in the tubes. The tube bundle in evaporator 38 can include a plurality of tubes and a plurality of tube bundles. The vapor refrigerant exits evaporator 38 and returns to compressor 32 by a suction line to complete the cycle.

Figure 4:
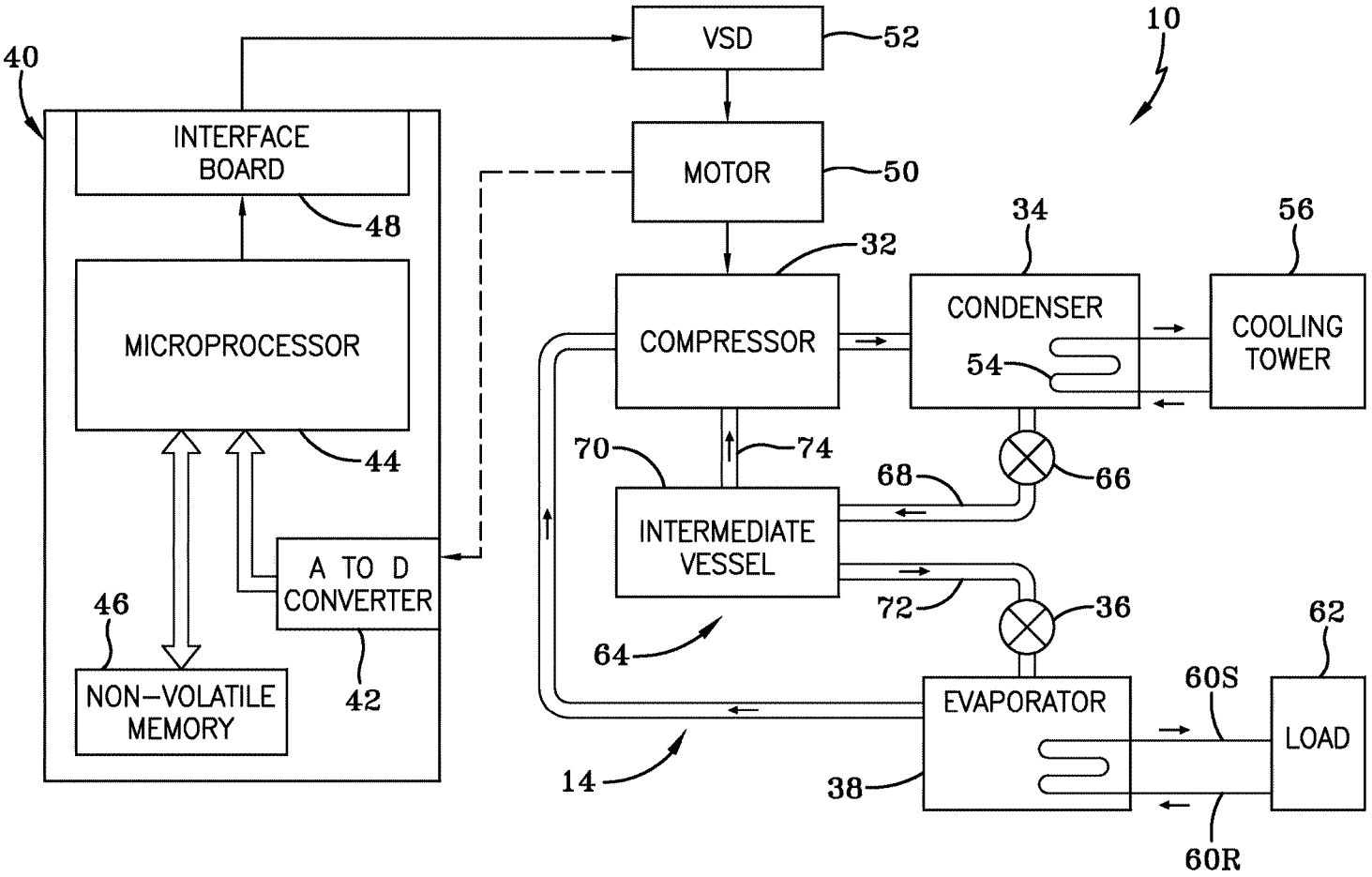

FIG. 4, which is similar to FIG. 3, shows the vapor compression system 14 with an intermediate circuit 64 incorporated between condenser 34 and expansion device 36. Intermediate circuit 64 has an inlet line 68 that can be either connected directly to or can be in fluid communication with condenser 34. As shown, inlet line 68 includes an expansion device 66 positioned upstream of an intermediate vessel 70. Intermediate vessel 70 can be a flash tank, also referred to as a flash intercooler, in an exemplary embodiment. In an alternate exemplary embodiment, intermediate vessel 70 can be configured as a heat exchanger or a "surface economizer." In the configuration shown in FIG. 4, i.e., the intermediate vessel 70 is used as a flash tank, a first expansion device 66 operates to lower the pressure of the liquid received from condenser 34. During the expansion process, a portion of the liquid vaporizes. Intermediate vessel 70 may be used to separate the vapor from the liquid received from first expansion device 66 and may also permit further expansion of the liquid. The vapor may be drawn by compressor 32 from intermediate vessel 70 through a line 74 to the suction inlet, a port at a pressure intermediate between suction and discharge or an intermediate stage of compression. The liquid that collects in the intermediate vessel 70 is at a lower enthalpy from the expansion process. The liquid from intermediate vessel 70 flows in line 72 through a second expansion device 36 to evaporator 38.

In an exemplary embodiment, compressor 32 can include a compressor housing that contains the working parts of compressor 32. Vapor from evaporator 38 can be directed to an intake passage of compressor 32. Compressor 32 compresses the vapor with a compression mechanism and delivers the compressed vapor to condenser 34 through a discharge passage. Motor 50 may be connected to the compression mechanism of compressor 32 by a drive shaft.

Vapor flows from the intake passage of compressor 32 and enters a compression pocket of the compression mechanism. The compression pocket is reduced in size by the operation of the compression mechanism to compress the vapor. The compressed vapor can be discharged into the discharge passage. For example, for a screw compressor, the compression pocket is defined between the surfaces of the rotors of the compressor. As the rotors of the compressor engage one another, the compression pockets between the rotors of the compressor, also referred to as lobes, are reduced in size and are axially displaced to a discharge side of the compressor.

As the vapor travels in the compression pocket, a port can be positioned in the compression mechanism prior to the discharge end. The port can provide a flow path for the vapor in the compression pocket from an intermediate point in the compression mechanism to the discharge passage. A valve can be used to open (completely or partially) and close the flow path provided by the port. In an exemplary embodiment, the valve can be used to control the volume ratio of compressor 32 by enabling or disabling the flow of vapor from the port to the discharge passage. The valve can provide two (or more) predetermined volume ratios for compressor 32 depending on the position of the valve.

The volume ratio for compressor 32 can be calculated by dividing the volume of vapor entering the intake passage (or the volume of vapor in the compression pocket before compression of the vapor begins) by the volume of vapor discharged from the discharge passage (or the volume of vapor obtained from the compression pocket after the compression of the vapor). Since the port is positioned prior to or upstream from the discharge end of the compression mechanism, vapor flow from the port to the discharge passage can increase the volume of vapor at the discharge passage because partially compressed vapor having a greater volume from the port is being mixed with completely or fully compressed vapor from the discharge end of the compression mechanism having a smaller volume. The volume of vapor from the port is greater than the volume of vapor from the discharge end of the compression mechanism because pressure and volume are inversely related, thus lower pressure vapor would have a correspondingly larger volume than higher pressure vapor. Thus, the volume ratio for compressor 32 can be adjusted based on whether or not vapor is permitted to flow from the port. When the valve is in the closed position, i.e., the valve prevents vapor flow from the port, compressor 32 operates at a full-load volume ratio. When the valve is in an open position, i.e., the valve permits vapor flow from the port, the compressor operates at a part-load volume ratio that is less than the full-load volume ratio. In an exemplary embodiment, there are several factors that can determine the difference between full-load volume ratio and part-load volume ratio, for example, the number and location of the ports and the amount of vapor flow permitted through the ports by the valve can all be used to adjust the part-load volume ratio for compressor 32. In an another exemplary embodiment, the configuration or shape of the ports 88 can be used to adjust the part-load volume ratio of compressor 32.

Figure 5:
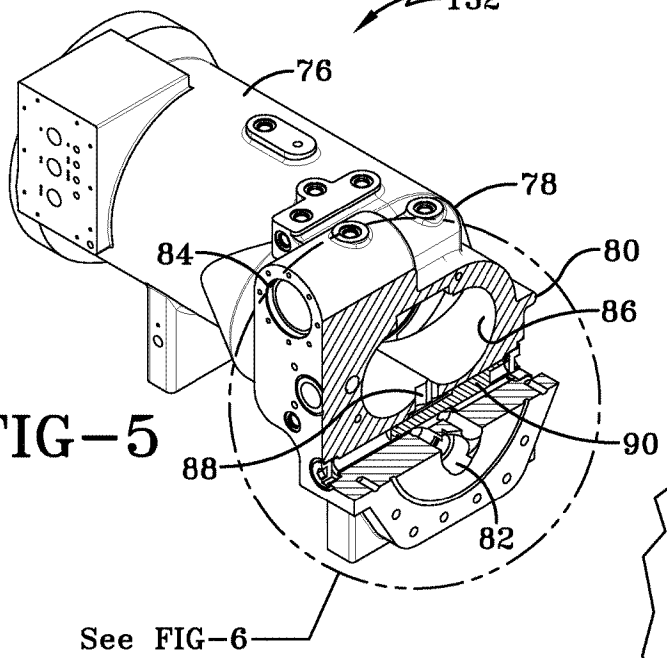
FIG. 5 shows a partial cut-away view of a compressor having an exemplary embodiment of a volume ratio control system.
Figure 6:
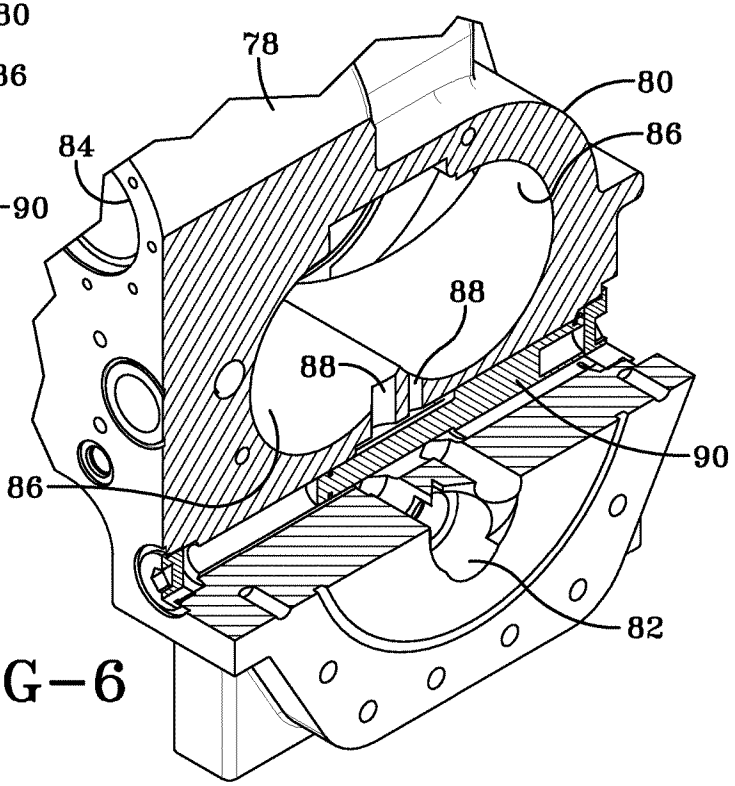
FIG. 6 shows an enlarged view of a portion of the compressor of FIG. 5.

FIGS. 5 and 6 show an exemplary embodiment of a compressor. Compressor 132 includes a compressor housing 76 that contains the working parts of compressor 132. Compressor housing 76 includes an intake housing 78 and a rotor housing 80. Vapor from evaporator 38 can be directed to an intake passage 84 of compressor 132. Compressor 132 compresses the vapor and delivers the compressed vapor to condenser 34 through a discharge passage 82. Motor 50 may be connected to rotors of compressor 132 by a drive shaft. The rotors of compressor 132 can matingly engage with each other via intermeshing lands and grooves. Each of the rotors of compressor 132 can revolve in an accurately machined cylinder 86 within rotor housing 80.

In the exemplary embodiment shown in FIGS. 5-8, a port 88 can be positioned in cylinder 86 prior to the discharge end of the rotors. Port 88 can provide a flow path for the vapor in the compression pocket from an intermediate point in the rotors to discharge passage 82. A valve 90 can be used to open (completely or partially) and close the flow path provided by port 88. Valve 90 can be positioned below the rotors and extend across compressor 132 substantially perpendicular to the flow of vapor. In an exemplary embodiment, valve 90 can automatically control the volume ratio of compressor 132 by enabling or disabling the flow of vapor from port 88 to discharge passage 82. Valve 90 can provide two (or more) predetermined volume ratios for compressor 132 depending on the position of valve 90. Port(s) 88 can extend through cylinder 86 in the portions of cylinder 86 associated with the male rotor and/or the female rotor. In an exemplary embodiment, the size of port(s) 88 associated the male rotor may differ from the size of port(s) 88 associated with the female rotor. Discharge passage 82 may partially extend below valve 90 and ports 88 may include channels fluidly connected to discharge passage 82.

Figure 7:
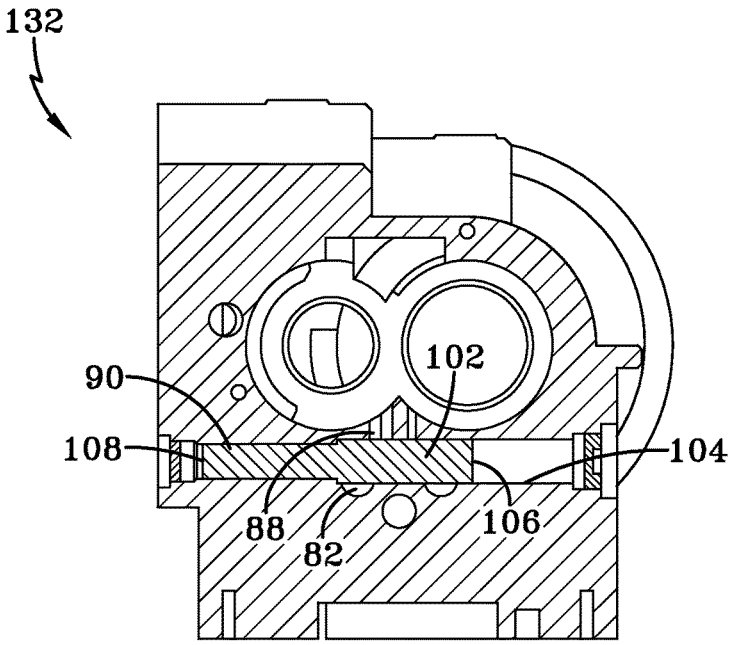
FIG. 7 shows a cross sectional view of the compressor of FIG. 5 configured for a first volume ratio.
Figure 8:
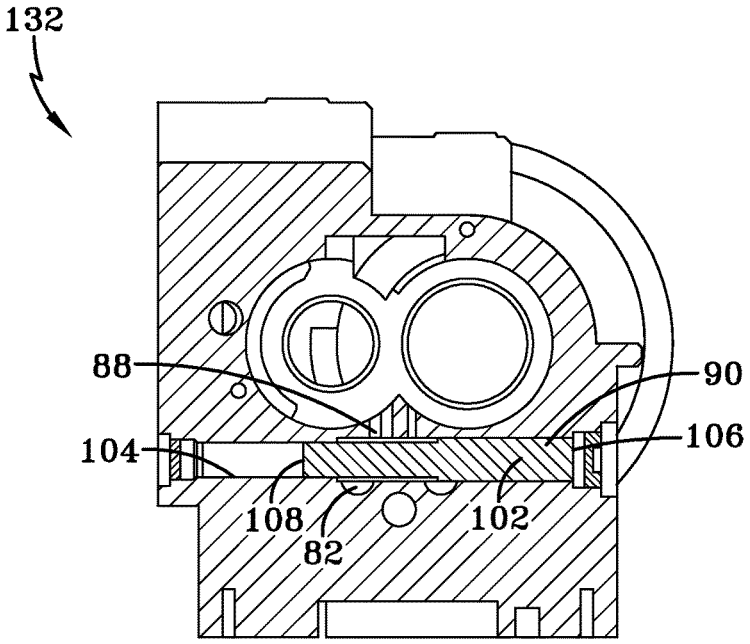
FIG. 8 shows a cross sectional view of the compressor of FIG. 5 configured for a second volume ratio.

FIGS. 7 and 8 show valve 90 in an open position and a closed position, respectively, to either permit or prevent vapor flow from port 88 to discharge passage 82. In FIG. 7, valve 90 is positioned in a closed position, thereby preventing or blocking the vapor flow from port 88 to discharge passage 82. With valve 90 in the closed position, compression of vapor by the rotors in compressor 132 can occur through reduction of the volume by the rotors as the vapor travels axially to discharge passage 82 which results in the full-load volume ratio for compressor 132.

In FIG. 8, valve 90 is positioned in an open position, thereby permitting the vapor flow from port 88 to discharge passage 82. With valve 90 in the open position, compression of vapor by the rotors in compressor 132 can occur through reduction of the volume by the rotors as the vapor travels axially toward the discharge passage 82. However, some of the vapor can flow into port 88 and then to discharge passage 82. Stated another way, a portion of the vapor in the compression pocket can bypass a portion of the rotors by traveling through port 88 to discharge passage 82 when valve 90 is in an open position. The vapor in discharge passage 82 from the discharge end of the rotors and the vapor from port 88 results in a greater volume of vapor at discharge and the part-load compression ratio for compressor 132.

Figure 9:
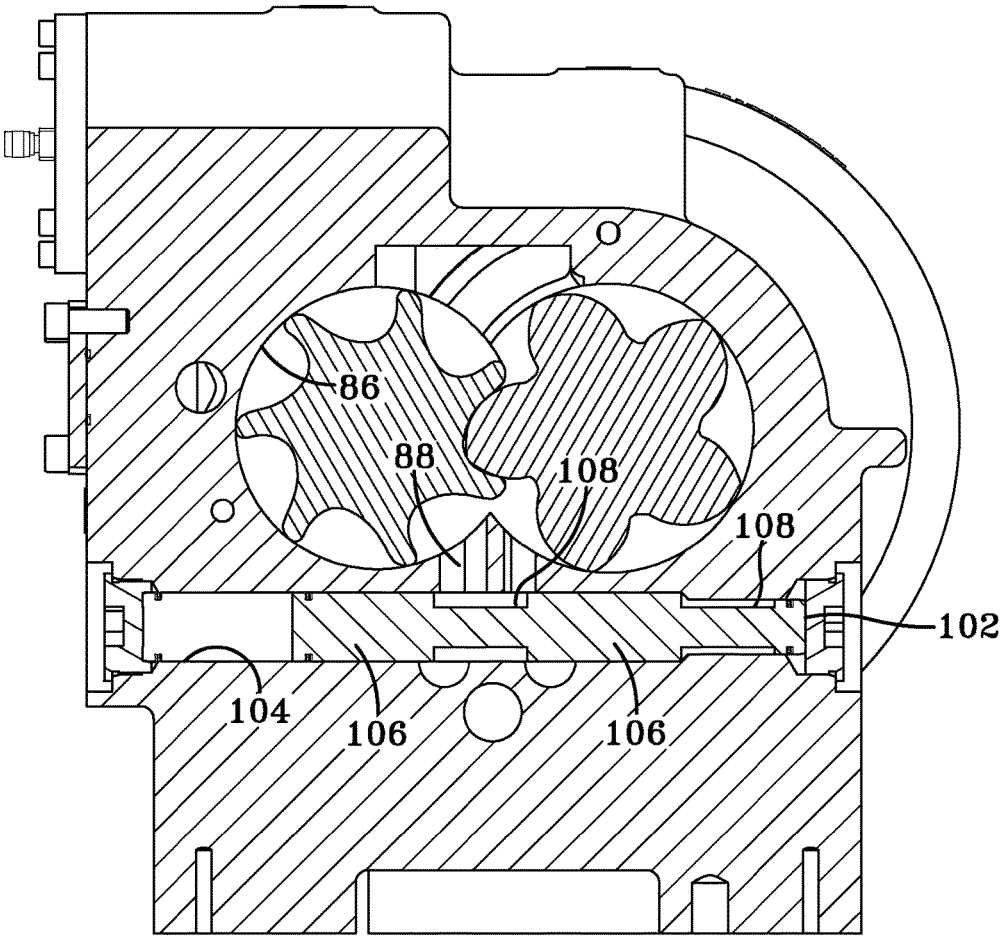
FIG. 9 shows a cross sectional view of the compressor of FIG. 5 with another exemplary embodiment of a valve body.

Valve 90 can include a valve body or shuttle 102 snugly positioned in a bore 104 to avoid unnecessary leakage. Valve body 102 can also include one or more gaskets or seals to prevent the leakage of fluids. Valve body 102 can have a varying diameters including a larger diameter portion 106 and a smaller diameter portion 108. In one exemplary embodiment as shown in FIG. 9, valve body 102 can have a large diameter portion 106 corresponding to each port 88 in cylinder 86. In one exemplary embodiment, the ends of bore 104 can be sealed and portions or volumes of bore 104 can be pressurized or vented with a fluid to move valve body 102 back and forth in bore 104. When the valve body 102 is positioned in the closed position (see FIGS. 7 and 9), larger diameter portion(s) 106 of valve body 102 block or close off ports 88. When the valve body 102 is positioned in the open position (see FIG. 8), smaller diameter portion 108 of valve body 102 is positioned near port 88 to permit flow of vapor from port 88 around smaller diameter portion 108 to discharge passage 82.

In an exemplary embodiment, valve 90 can be opened or closed automatically in response to suction pressure, e.g., the pressure of vapor entering intake passage 84, and discharge pressure, e.g., the pressure of vapor discharged from discharge passage 82. For example, suction pressure may be applied to larger diameter portion 106 located at one end of valve body 102 and discharge pressure may be applied to smaller diameter portion 108 located at the other end of valve body 102. Fluid at suction pressure can be provided to bore 104 and larger diameter portion 106 through internal or external piping to create a first force on valve body 102. The first force applied to valve body 102 can be equal to the fluid pressure (suction pressure) multiplied by the area of larger diameter portion 106. Similarly, fluid at discharge pressure can be provided to bore 104 and smaller diameter portion 108 through internal or external piping to create a second force on valve body 102 opposing the first force on valve body 102. The second force applied to valve body 102 can be equal to the fluid pressure (discharge pressure) multiplied by the area of smaller diameter portion 108.

Figure 10:
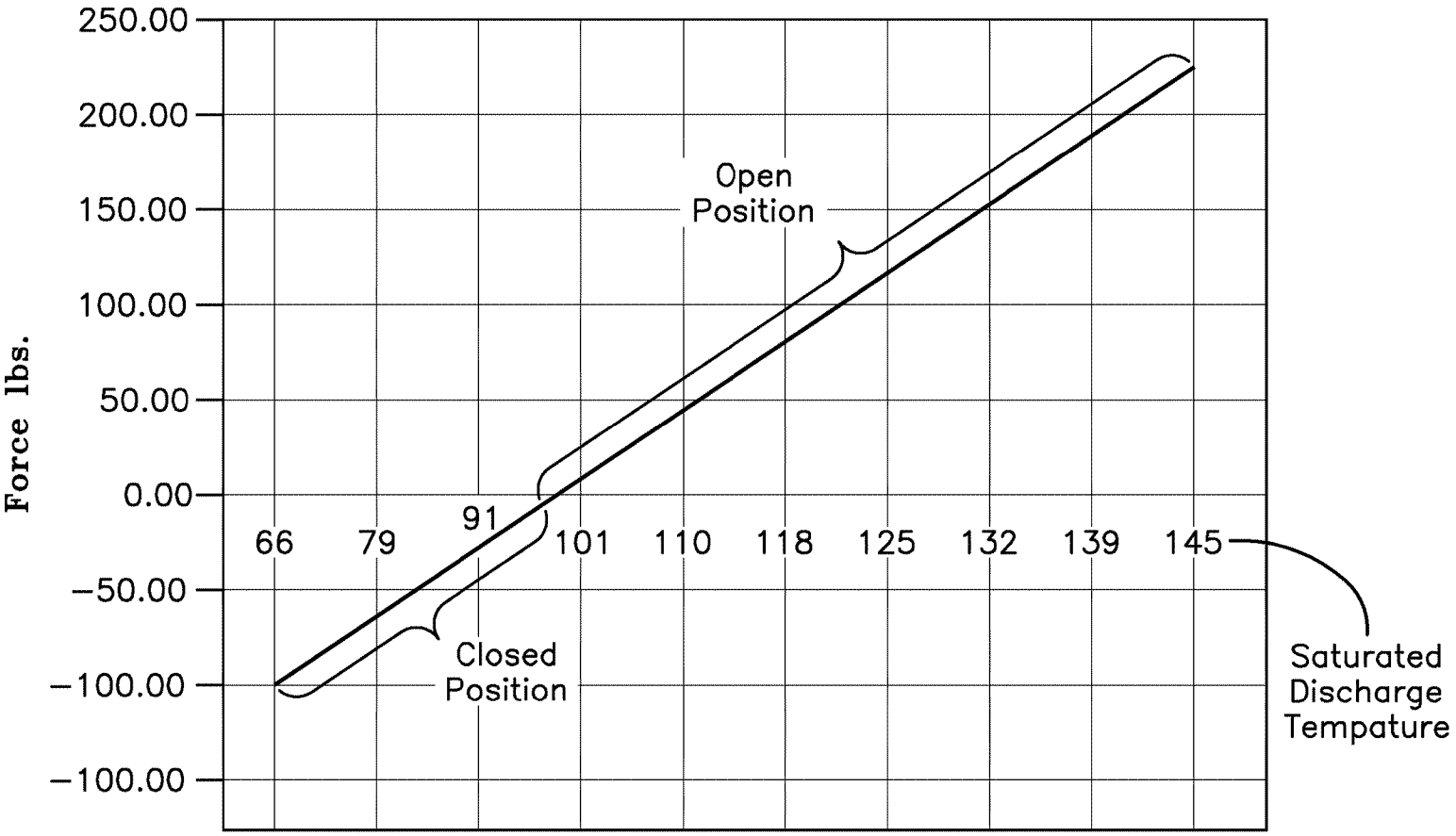
FIG. 10 shows a chart of force differentials on the valve body for selected saturated discharge temperatures in an exemplary embodiment.
Figure 11:
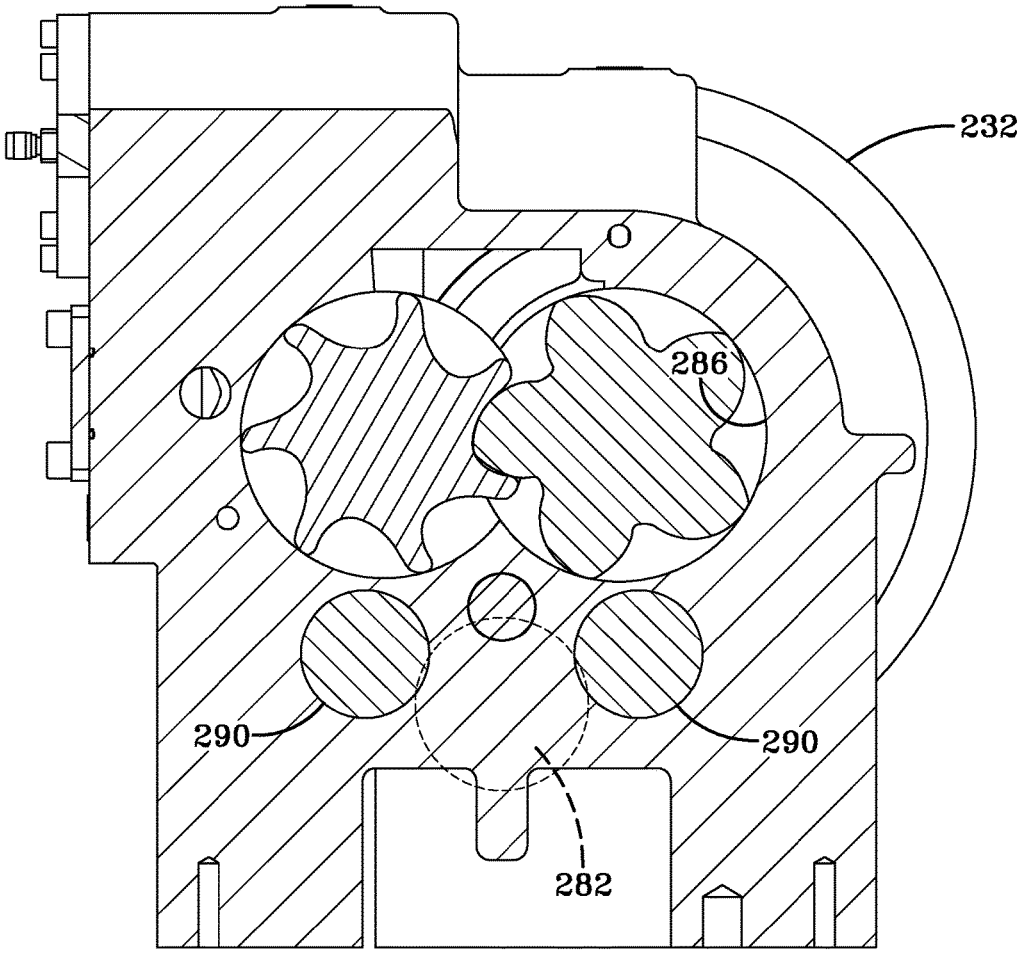
FIG. 11 shows a cross sectional view of a compressor having another exemplary embodiment of a volume ratio control system.

When the first force equals the second force, valve body 102 can remain in a substantially stationary position. When the first force exceeds the second force, valve body 102 can be urged or moved in bore 104 to position valve 90 in either the open position or the closed position. In the exemplary embodiment shown in FIG. 7, the first force would move valve body 102 toward the closed position. In contrast, when the second force is greater than the first force, valve body 102 can be urged or moved in bore 104 to position valve 90 in the opposite position from the positioned obtained when the first force is larger. In the exemplary embodiment shown in FIG. 8, the second force would move valve body 102 toward the open position. FIG. 10 is a chart showing force differentials between the first force and the second force on valve body 102 (and corresponding valve positions) for selected saturated discharge temperatures in an exemplary embodiment and gives an example of a specific switch point for valve body 102. The switch point can be moved by adjusting the pressures or spring force acting on valve body 102.

In an exemplary embodiment, the sizing of larger diameter portion 106 and smaller diameter portion 108 may permit automatic movement of valve body 102 when the suction and discharge pressures reach a predetermined point. For example, the predetermined point may correlate with a preselected compression ratio or a preselected volume ratio. In another exemplary embodiment, valve 90 can include a mechanical stop, for example a shoulder positioned in bore 104, to limit the movement of valve body 102 to two positions (for example, closed and open). In another exemplary embodiment, valve body 102 can be moved to an intermediate position between the open and closed position that permits partial flow of vapor from port 88 to obtain another volume ratio for compressor 132. In a further exemplary embodiment, valve body 102 can have several portions of varying diameters to obtain different volume ratios for compressor 132 based on the amount of vapor flow from port 88 each varying diameter permits.

In another exemplary embodiment, a spring can be positioned in bore 104 near larger diameter portion 106 to supplement the first force. The use of the spring can smooth the transition between the closed position and the open position and can avoid frequent switching between positions if the force differential remains near the switching point. In another exemplary embodiment, a spring can also be positioned in bore 104 near smaller diameter portion 108 to supplement the second force.

In still another exemplary embodiment, the position of valve body 102 can be controlled with one or more solenoid valves to vary the pressures at each end of valve body 102. The solenoid valve can be controlled by sensing suction and discharge pressures outside or exterior of compressor 132 and then adjusting the pressures on each end of the valve body 102.

In the exemplary embodiment shown in FIGS. 11-14, ports 288 can be positioned in cylinder 286 prior to the discharge end of the rotors. Ports 288 can provide a flow path for the vapor in the compression pocket from an intermediate point in the rotors to discharge passage 282. Valves 290 can be used to open (completely or partially) and close the flow path provided by ports 288. Valves 290 can be positioned below the rotors and extend substantially parallel to the flow of vapor in compressor 232. In an exemplary embodiment, valves 290 can control the volume ratio of compressor 232 by enabling or disabling the flow of vapor from ports 288 to discharge passage 282 in response to system conditions. Valves 290 can provide two (or more) predetermined volume ratios for compressor 232 depending on the position of valves 290. Ports 288 can extend through cylinder 286 in the portions of cylinder 286 associated with the male rotor and/or the female rotor. In an exemplary embodiment, the size of ports 288 associated the male rotor may differ from the size of ports 288 associated with the female rotor. Discharge passage 282 may partially extend below valves 290 and ports 288 may include channels fluidly connected to discharge passage 282.

Figure 12:
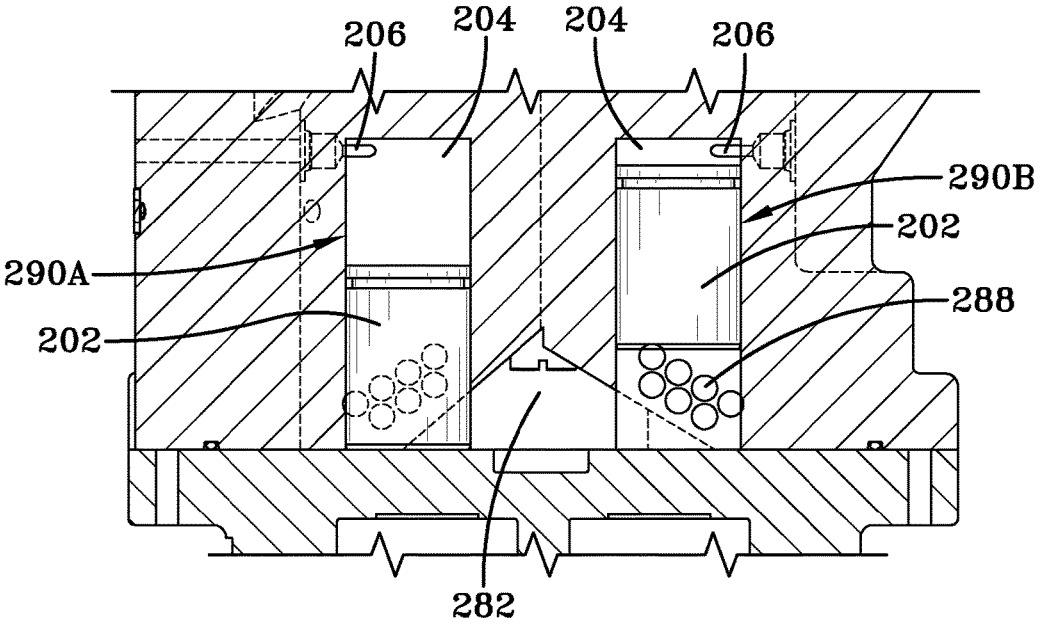
FIG. 12 shows a cross sectional view of the compressor of FIG. 11.
Figure 13:
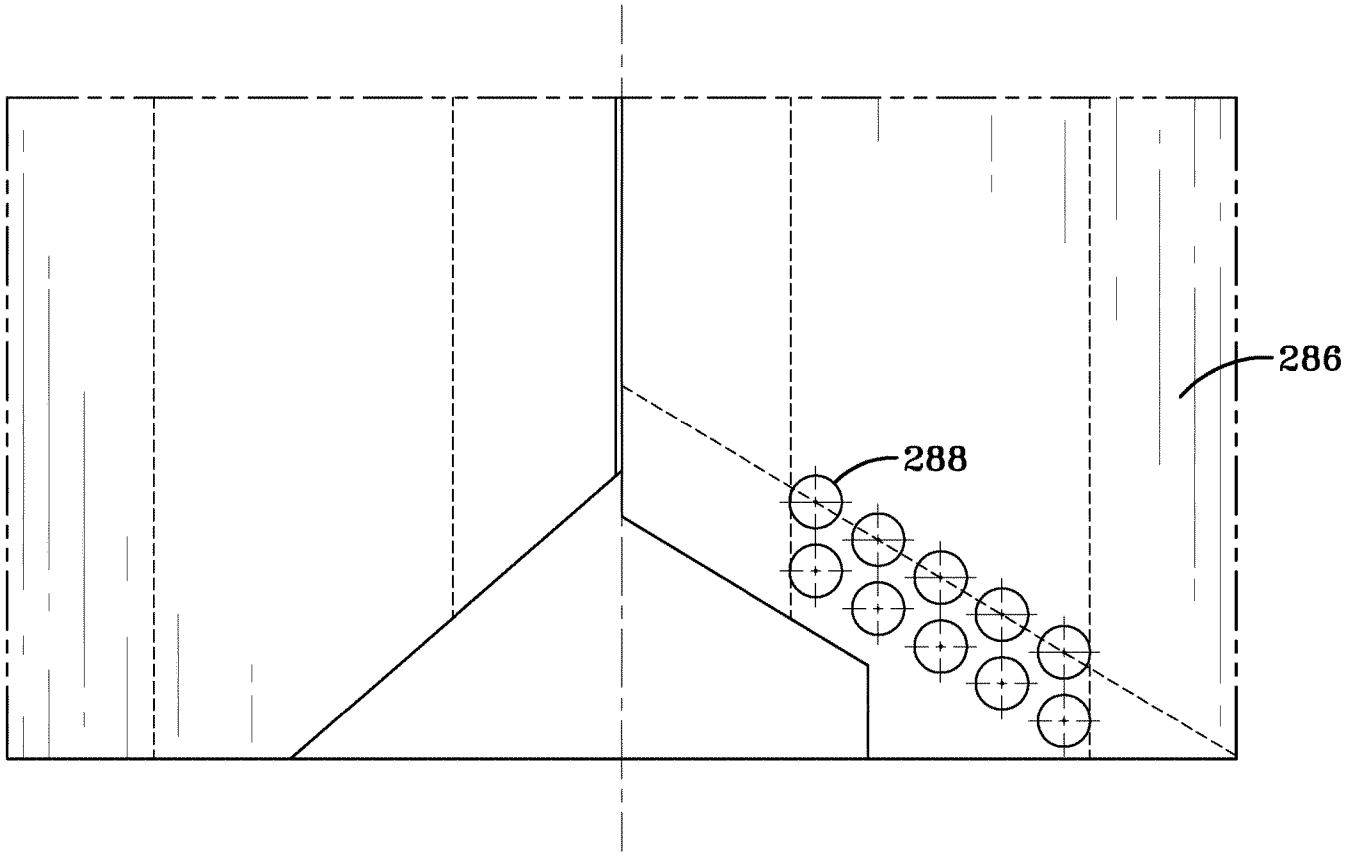
FIG. 13 shows an exemplary embodiment of a hole pattern for the compressor of FIG. 11.
Figure 14:
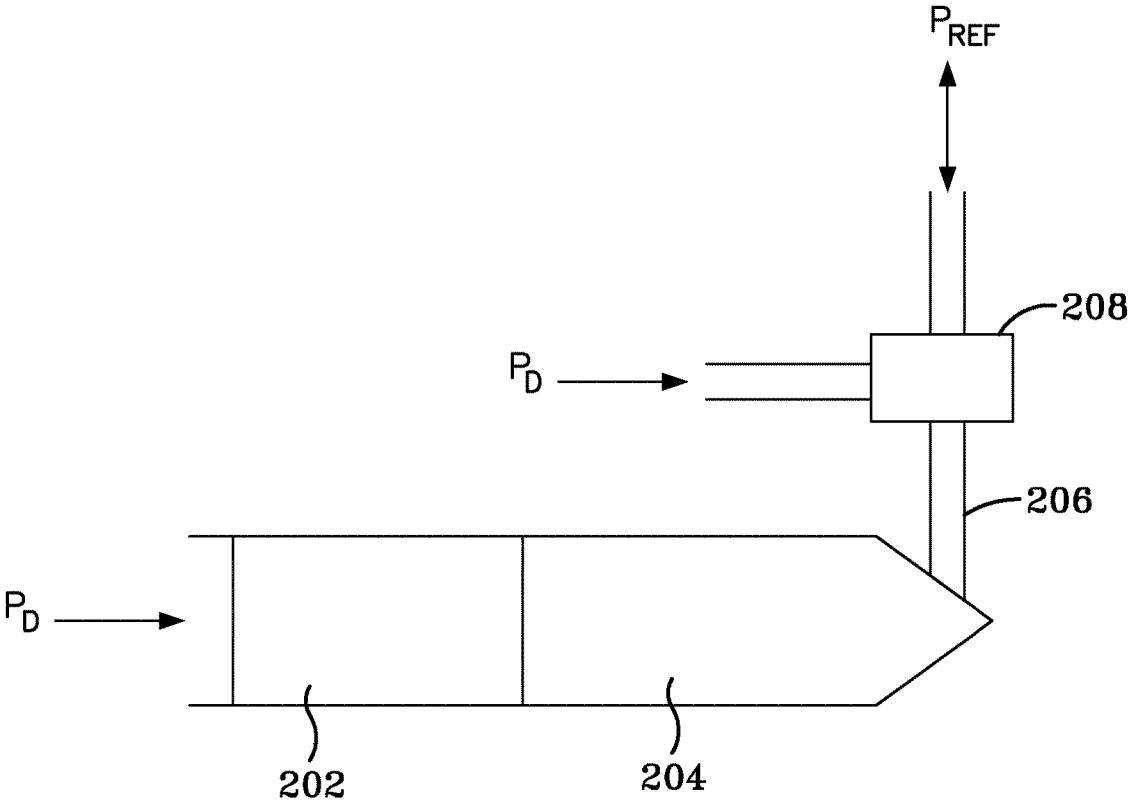
FIG. 14 shows schematically another embodiment of a volume ratio control system that can be used with the compressor of FIG. 11.

FIG. 12 shows valve 290A positioned in a closed position, thereby preventing or blocking the vapor flow from port 288 to discharge passage 282 and shows valve 290B positioned in an open position thereby permitting the vapor flow from port 288 to discharge passage 282. With valve 290A in the closed position and valve 290B in the open position, compression of vapor by the rotors in compressor 232 can occur through reduction of the volume by the rotors as the vapor travels axially toward the discharge passage 282 for both valves 290A and 290B. However, some of the vapor can flow into ports 288 associated with valve 290B and then to discharge passage 282. The vapor in discharge passage 282 from the discharge end of the rotors and the vapor from ports 288 associated with valve 290B results in a greater volume of vapor at discharge and a first part-load compression ratio for compressor 232.

When both valves 290A and 290B are in the closed position, compression of vapor by the rotors in compressor 232 can occur through reduction of the volume by the rotors as the vapor travels axially to discharge passage 282 which results in the full-load volume ratio for compressor 232. When both valves 290A and 290B are in the open position, compression of vapor by the rotors in compressor 232 can occur through reduction of the volume by the rotors as the vapor travels axially toward the discharge passage 282. However, some of the vapor can flow into ports 288 and then to discharge passage 282. Stated another way, a portion of the vapor in the compression pocket can bypass a portion of the rotors by traveling through ports 288 to discharge passage 282 when valves 290A and 290B are in an open position. The vapor in discharge passage 282 from the discharge end of the rotors and the vapor from ports 288 results in a greater volume of vapor at discharge and a second part-load compression ratio for compressor 132 that is lower than the first part-load compression ratio.

Valves 290 can include a valve body 202 snugly positioned in a bore 204 to avoid unnecessary leakage. Valve body 202 can also include one or more gaskets or seals to prevent the leakage of fluids. Valve body 202 can have a substantially uniform diameter. In one exemplary embodiment, one end of bore 204 can be sealed and a fluid connection 206 can be provided near the sealed end of bore 204. The other end of bore 204 can be exposed to fluid at discharge pressure. Fluid connection 206 can be used to adjust the magnitude of the fluid pressure in the sealed end of bore 204, i.e., pressurize or vent the sealed end of bore 204, to move valve body 202 back and forth in bore 204. Fluid connection 206 can be connected to a valve 208 (see FIG. 14), for example a proportional valve or 3-way valve, that is used to supply fluids of different pressures to the sealed end of bore 204 through fluid connection 206. Valve 208 can permit fluid at discharge pressure ($P_D$), fluid at a reference pressure less than discharge pressure ($P_{REF}$), or a mixture of fluid at the discharge pressure and the reference pressure to flow into fluid connection 206. In one exemplary embodiment, the reference pressure can be equal to or greater than the suction pressure. In another exemplary embodiment, valve 208 can be operated with oil from the lubrication system. In still another exemplary embodiment, more than one valve can be used to supply fluid to fluid connection 206. Valve 208 can be controlled by a control system based on measured system parameters, such as discharge pressure, suction pressure, evaporating temperature, condensing temperature or other suitable parameters. When the valve body 202 is positioned in the closed position, valve body 202 blocks or closes off ports 288. When the valve body 202 is positioned in the open position, valve body 202 is at least partially moved away from the ports 288 to permit flow of vapor from ports 288 to discharge passage 282. The vapor can flow from ports 288 to discharge passage 282 because the pressure in the compression pocket is at a higher pressure than the discharge pressure. Once the vapor enters ports 288 there can be a pressure drop in the vapor because of the expansion of the vapor into bore 204.

In an exemplary embodiment, valves 290 can be opened or closed in response to the supply or withdrawal of fluid from the sealed end of bore 204. To move valve body 202 into the closed position, fluid at discharge pressure is provided to fluid connection 206 by valve 208. The fluid at discharge pressure moves valve body 202 away from the sealed end of bore 204 to close or seal ports 288 by overcoming the force applied to the opposite side of valve body 202. In contrast, to move valve body 202 into the open position, fluid at reference pressure is provided to fluid connection 206 by valve 208. The fluid at reference pressure enables valve body 202 to move towards the sealed end of bore 204 to open or uncover ports 288 since the force applied to the opposite side of valve body 202 is greater than the force applied to valve body 202 at the sealed end of bore 204. The use of valve 208 to adjust the magnitude of the fluid pressure in the sealed end of bore 204 permits valves 290 to be opened and closed in response to specific system conditions.

In another exemplary embodiment, a spring can be positioned in the sealed end of bore 204 to supplement the force of the fluid used to close the valve. The use of the spring can smooth the transition between the closed position and the open position and can avoid frequent switching between positions if the force differential remains near the switching point.

In a further exemplary embodiment, the valves 290 can be independently controlled to permit one valve 290 to be opened, while closing the other valve 290. When the valves 290 are independently controlled, each valve 290 can have a corresponding valve 208 that is independently controlled to supply fluid to valve 290 as determined by system conditions. In another exemplary embodiment, the valves 290 can be jointly controlled to have both valves opened or closed at the same time. When the valves are jointly controlled a single valve 208 can be used to supply fluid to the valves 290. However, each valve 290 may have a corresponding valve 208 that receives common or joint control signals to open or close the valves 290.

Figure 15:
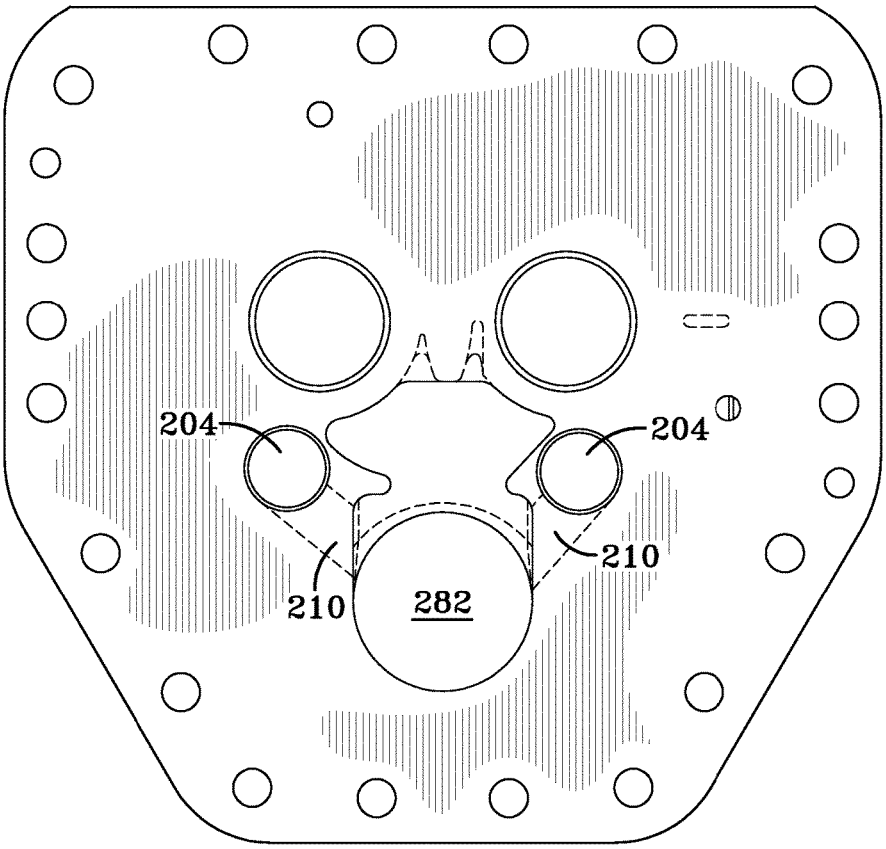
FIG. 15 shows a cross sectional view of a compressor having a further exemplary embodiment of a valve used with the volume ratio control system.

In still another exemplary embodiment shown in FIG. 15, the bores 204 may be connected to discharge passage 282 by channels 210. Channels 210 may be used when the size of bore 204 does not permit a direct fluid connection between bore 204 and discharge passage 282. Channels 210 can have any suitable size or shape to permit fluid flow from bore 204 to discharge passage 282.

Figure 16:
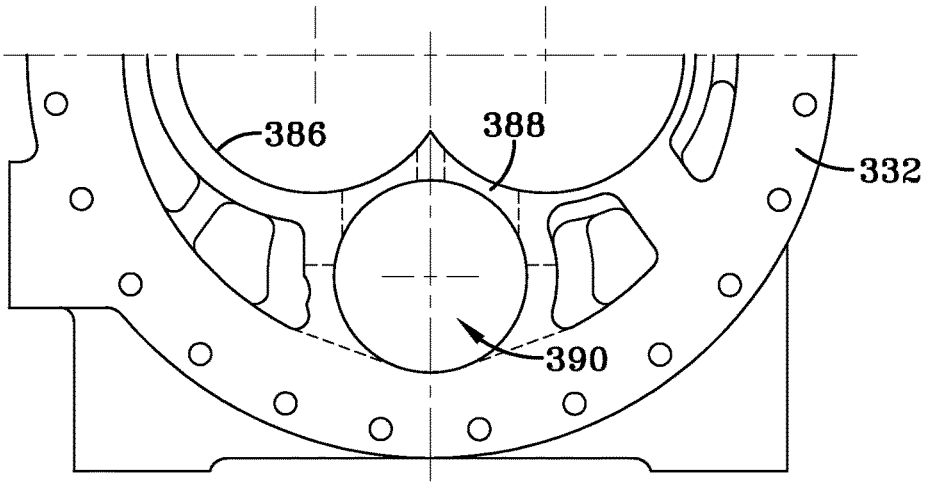
FIG. 16 shows a cross sectional view of a compressor having another exemplary embodiment of a volume ratio control system.
Figure 18:
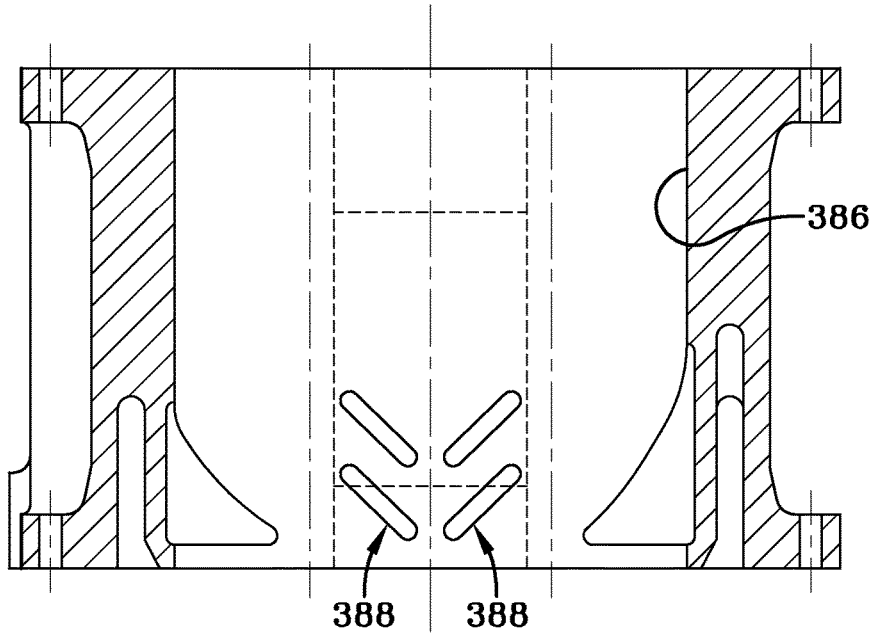
FIG. 18 shows a cross sectional view of the compressor of FIG. 16 with an exemplary hole pattern.
Figure 17:
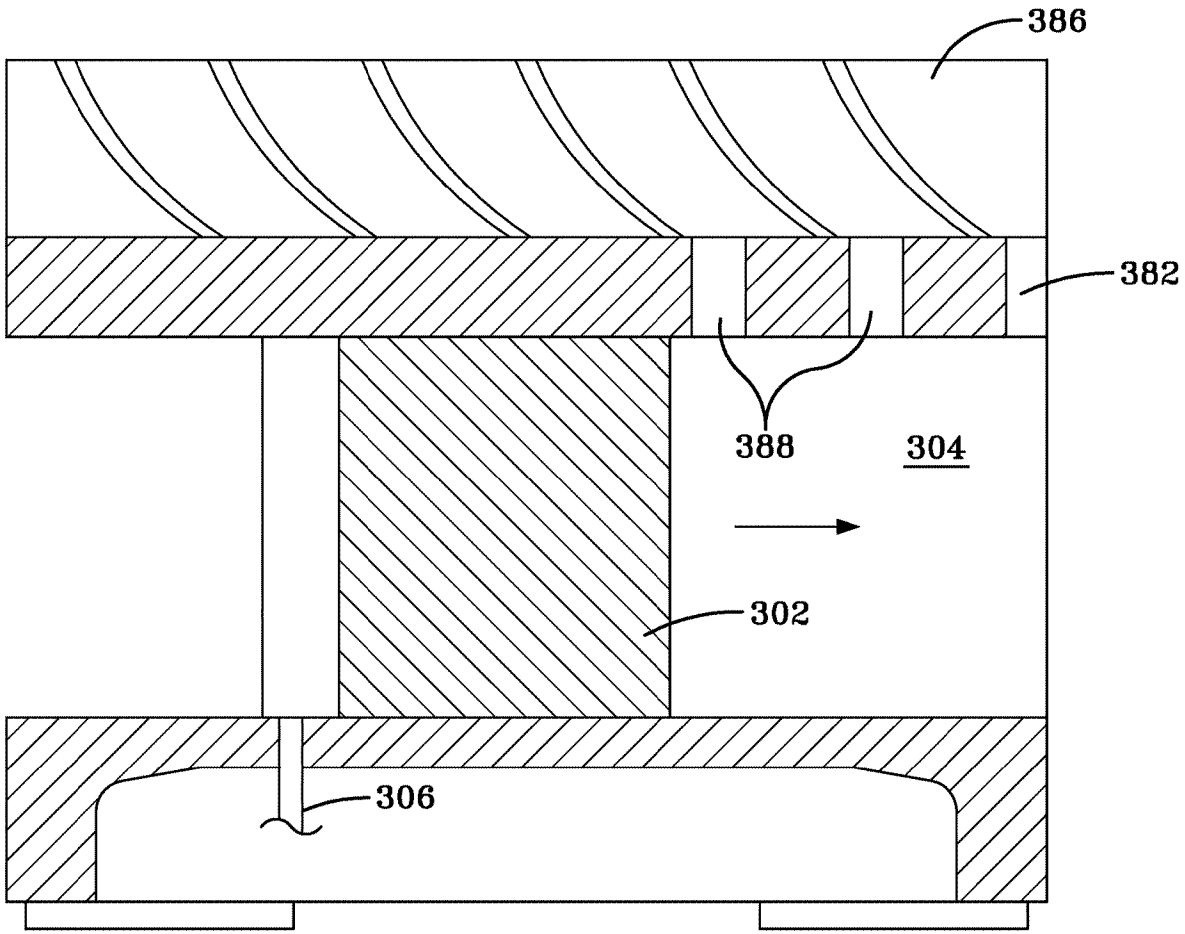
FIG. 17 shows a cross sectional view of the compressor of FIG. 16.

In the exemplary embodiment shown in FIGS. 16-18, ports 388 can be positioned in cylinder 386 prior to the discharge end of the rotors. Ports 388 can provide a flow path for the vapor in the compression pocket from an intermediate point in the rotors to discharge passage 382. Valve 390 can be used to open (completely or partially) and close the flow path provided by ports 388. Valve 390 can be positioned below the rotors at a position substantially centered between the rotors and extend substantially parallel to the flow of vapor in compressor 332. In an exemplary embodiment, valve 390 can control the volume ratio of compressor 332 by enabling or disabling the flow of vapor from ports 388 to discharge passage 382 in response to system conditions. Valve 390 can provide two (or more) predetermined volume ratios for compressor 332 depending on the position of valve 390. Ports 388 can extend through cylinder 386 in the portions of cylinder 386 associated with the male rotor and/or the female rotor. In an exemplary embodiment, the size of ports 388 associated the male rotor may differ from the size of ports 388 associated with the female rotor.

FIG. 16 shows valve 390 positioned in a closed position, thereby preventing or blocking the vapor flow from ports 388 to discharge passage 382. When valve 390 is in the closed position, compression of vapor by the rotors in compressor 332 can occur through reduction of the volume by the rotors as the vapor travels axially to discharge passage 382 which results in the full-load volume ratio for compressor 332. FIG. 17 shows valve 390 positioned in an open position thereby permitting the vapor flow from ports 388 to discharge passage 382. When valve 390 is in the open position, compression of vapor by the rotors in compressor 332 can occur through reduction of the volume by the rotors as the vapor travels axially toward the discharge passage 382. However, some of the vapor can flow into ports 388 and then to discharge passage 382. Stated another way, a portion of the vapor in the compression pocket can bypass a portion of the rotors by traveling through ports 388 to discharge passage 382 when valve 390 is in an open position. The vapor in discharge passage 382 from the discharge end of the rotors and the vapor from ports 388 results in a greater volume of vapor at discharge and a part-load compression ratio for compressor 332 that is lower than the full-load compression ratio.

Valve 390 can include a valve body 302 snugly positioned in a bore 304 to avoid unnecessary leakage. Valve body 302 can also include one or more gaskets or seals to prevent the leakage of fluids. Valve body 302 can have a substantially uniform diameter. In one exemplary embodiment, one end of bore 304 can be sealed and a fluid connection 306 can be provided near the sealed end of bore 304. The other end of the bore can be exposed to fluid at discharge pressure. Fluid connection 306 can be used to adjust the magnitude of the fluid pressure in the sealed end of bore 204, i.e., pressurize or vent the sealed end of bore 204, to move valve body 302 back and forth in bore 304. Fluid connection 306 can be connected to a valve, for example a proportional valve or 3-way valve, that is used to supply fluids of different pressures to the sealed end of bore 304 through fluid connection 306. Fluid at discharge pressure ($P_D$), fluid at a reference pressure less than the discharge pressure ($P_{REF}$), or a mixture of fluid at discharge pressure and reference pressure can flow into fluid connection 306. In another exemplary embodiment, more than one valve can be used to supply fluid to fluid connection 306. The valve supplying fluid connection 306 can be controlled by a control system based on measured system parameters, such as discharge pressure, suction pressure, evaporating temperature, condensing temperature or other suitable parameters. When the valve body 302 is positioned in the closed position, valve body 302 blocks or closes off ports 388. When the valve body 302 is positioned in the open position, valve body 302 is moved from the ports 388 to permit flow of vapor from ports 388 to discharge passage 382.

In an exemplary embodiment, valve 390 can be opened or closed in response to the supply or withdrawal of fluid from the sealed end of bore 304. To move valve body 302 into the closed position, fluid at discharge pressure is provided to fluid connection 306. The fluid at discharge pressure moves valve body 302 away from the sealed end of bore 304 to close or seal ports 388 by overcoming the force on the opposite side of valve body 302. In contrast, to move valve body 302 into the open position, fluid at reference pressure is provided to fluid connection 306. The fluid at reference pressure enables valve body 302 to move towards the sealed end of bore 304 to open or uncover ports 388 since the force applied to the opposite side of valve body 302 is greater than the force applied to valve body 302 at the sealed end of bore 304. The pressurizing or venting of the sealed end of bore 304, permits valve 390 to be opened and closed in response to specific conditions.

In another exemplary embodiment, a spring can be positioned in the sealed end of bore 304 to supplement the force of the fluid used to close the valve. The use of the spring can smooth the transition between the closed position and the open position.

In exemplary embodiments, the ports and/or the valves of the volume ratio control system can be used to adjust the volume ratio of the compressor by adjusting the size of the ports and/or the valves, and/or the positioning of the ports and/or the valves with respect to the rotors and/or the discharge path. By increasing the size of the ports, a larger volume of the vapor can pass through ports. Similarly, by decreasing the size of the ports, a smaller volume of the vapor can pass through the ports. Additionally or alternatively, including multiple ports with respect to one valve can increase the volume of the vapor. By positioning the ports and valves closer to the discharge end of the rotors, the difference in volume of the vapor traveling through the ports can be lower. Similarly, by positioning the ports and valves farther from the discharge end of the rotors, the difference in volume of the vapor traveling through the ports can be higher.

In other exemplary embodiments, the bores and the valve bodies used in the valves can have standard shapes that are easily manufactured. For example, the bores can have a cylindrical shape, including a right circular cylindrical shape, and the valve bodies can have a corresponding cylindrical or piston shape, including a right circular cylindrical shape. However, the bores and valve bodies can have any suitable shape that can open and close the ports in the cylinder as required.

In another exemplary embodiment, a slide valve and corresponding controls can be used with the volume ratio control system. The use of a slide valve with the volume ratio control system can provide a smoother Vi vs. capacity curve.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A compressor comprising:

a compression mechanism, the compression mechanism being configured and positioned to receive vapor from an intake passage and provide compressed vapor to a discharge passage;

a port positioned in the compression mechanism to bypass a portion of the vapor in the compression mechanism to the discharge passage;

a valve comprising a valve body positioned in a bore configured and positioned to control vapor flow through the port, the valve body having a first position to unobstructedly permit vapor flow from the compression mechanism to the discharge passage, a second position to prevent vapor flow from the compression mechanism to the discharge passage, and a third position between the first position and the second position to partially permit vapor flow from the compression mechanism to the discharge passage, the valve body in the second position preventing vapor flow by blocking the port without insertion of the valve body inside the port, and the valve body in the third position partially permitting vapor flow by partially blocking the port without insertion of the valve body inside the port;

the compressor having a first volume ratio in response to the valve body being in the second position, a second volume ratio in response to the valve body being in the first position, and a third volume ratio in response to the valve body being in the third position, the first volume ratio being greater than the second volume ratio and the third volume ratio being between the first volume ratio and the second volume ratio; and the valve body being automatically positionable using the pressure of the vapor entering the intake passage and the pressure of the compressed vapor discharged from the discharge passage to operate the compressor at the first volume ratio, the second volume ratio or the third volume ratio;

wherein the valve body is movable in the bore between the first position and the second position in response to a difference in forces applied to opposite ends of the valve body.

2. The compressor of claim 1 wherein:

the compressed vapor discharged from the discharge passage at a first pressure is supplied to the bore to apply a first force on a first end of the valve body near the discharge passage; and the vapor entering the intake passage at a second pressure is supplied to the bore to apply a second force on a second end of the valve body opposite the first end.

3. The compressor of claim 2 wherein:

the valve body is in the first position when positioned in the bore a distance from the port to unobstructedly permit flow of vapor through the port and into the bore;

the valve body is in the second position when positioned in the bore to close the port to prevent flow of vapor through the port and into the bore; and the valve body is positioned in the first position in response to the first force being greater than the second force and the valve body is positioned in the second position in response to the second force being greater than the first force.

4. The compressor of claim 1 wherein the bore is positioned in the compression mechanism substantially parallel to a flow of vapor in the compression mechanism.

5. A screw compressor comprising:

a pair of intermeshing rotors, each rotor of the pair of intermeshing rotors being positioned in a corresponding cylinder, the pair of intermeshing rotors being configured to receive vapor from an intake passage and provide compressed vapor to a discharge passage;

a port positioned in at least one rotor cylinder to bypass a portion of the vapor from a compression pocket formed by the pair of intermeshing rotors to the discharge passage;

a valve comprising a valve body positioned in a bore configured and positioned to control vapor flow through the port, the valve body having a fully open position to unobstructedly permit vapor flow from the compression pocket to the discharge passage, a closed position to prevent vapor flow from the compression pocket to the discharge passage, and a partially open position to partially permit vapor flow from the compression pocket to the discharge passage, the valve body in the closed position preventing vapor flow by blocking the port without insertion of the valve body inside of the port, the valve body in the partially open position partially blocking the port without insertion of the valve body inside of the port;

the screw compressor having a first volume ratio in response to the valve body being in the closed position, a second volume ratio in response to the valve body being in the fully open position, and a third volume ratio in response to the valve body being in the partially open position between the closed position and the fully open position, the first volume ratio being greater than the second volume ratio and the third volume ratio being between the first volume ratio and the second volume ratio; and the valve body being automatically positionable using the pressure of vapor entering the intake passage and the pressure of vapor discharged from the discharge passage to operate the compressor at the first volume ratio, the second volume ratio, or the third volume ratio.

6. The screw compressor of claim 5 wherein the bore is positioned between the cylinders or near one cylinder.

7. The screw compressor of claim 5 wherein:

the valve body comprises a first valve body portion positioned in a first bore portion of the bore and a second valve body portion positioned in a second bore portion of the bore;

the first bore portion and the second bore portion are positioned near a corresponding cylinder substantially parallel to a flow of vapor in the pair of intermeshing rotors; and the valve body is in the fully open position in response to at least one of the first valve body portion or the second valve body portion being positioned in a corresponding bore portion a distance from the port to permit flow of vapor through the port.

8. The screw compressor of claim 5 wherein:

the vapor discharged from the discharge passage at a discharge pressure is supplied to the bore to apply a first force on a first end of the valve body near the discharge passage;

the vapor entering the intake passage at a second pressure is supplied to the bore to apply a second force on a second end of the valve body opposite the first end; and the valve body is movable in the bore between the fully open position and the closed position in response to a difference in the first force and the second force applied to the valve body.

9. The screw compressor of claim 8 further comprising a control valve to control flow of the vapor entering the intake passage, the control valve being configured to provide the vapor discharged from the discharge passage at the discharge pressure or the vapor entering the intake passage at the second pressure, less than the discharge pressure.

10. The screw compressor of claim 8 wherein:

the valve body is in the fully open position when positioned in the bore a distance from the port to permit unobstructed flow of vapor through the port and into the bore;

the valve body is in the closed position when positioned in the bore to close the port to prevent flow of vapor through the port and into the bore; and the valve body is positioned in the fully open position in response to the first force being greater than the second force and the valve body is positioned in the closed position in response to the second force being greater than the first force.

11. The compressor of claim 5 wherein the bore is positioned in the screw compressor substantially parallel to a flow of vapor in the screw compressor.

* * * * *